US008416959B2

(12) United States Patent
Lott et al.

(10) Patent No.: US 8,416,959 B2
(45) Date of Patent: Apr. 9, 2013

(54) HEARING ENHANCEMENT SYSTEM AND COMPONENTS THEREOF

(75) Inventors: Dale Lott, Nashville, TN (US); William T. Newton, Old Hickory, TN (US)

(73) Assignee: SPEAR Labs, LLC., Goodlettsville, TN (US)

( * ) Notice: Subject to any disclaimer, the term of this patent is extended or adjusted under 35 U.S.C. 154(b) by 712 days.

(21) Appl. No.: 12/551,805

(22) Filed: Sep. 1, 2009

(65) Prior Publication Data

US 2011/0038496 A1 Feb. 17, 2011

Related U.S. Application Data

(60) Provisional application No. 61/234,598, filed on Aug. 17, 2009.

(51) Int. Cl.
*G10K 11/16* (2006.01)

(52) U.S. Cl.
USPC ..... 381/71.6; 381/309; 381/92; 381/95; 381/98; 379/406.08; 379/406.06

(58) Field of Classification Search ..... 381/71.6, 381/71.4, 71.3, 71.1, 71.11, 71.12, 71.14, 381/92, 74, 72, 122, 98, 103, 106, 111, 121, 381/120, 309, 26, 95; 379/406.01–406.16; 455/569.2, 570, 63.1, 114.2, 296
See application file for complete search history.

(56) References Cited

U.S. PATENT DOCUMENTS

| | | | | |
|---|---|---|---|---|
| 3,683,130 | A * | 8/1972 | Kahn | 455/575.2 |
| 4,455,675 | A | 6/1984 | Bose et al. | |
| 4,479,239 | A * | 10/1984 | Rhines | 381/72 |
| 5,675,658 | A | 10/1997 | Brittain | |
| 5,732,143 | A | 3/1998 | Andrea et al. | |
| 6,061,456 | A | 5/2000 | Andrea et al. | |
| 2003/0198357 | A1 * | 10/2003 | Schneider et al. | 381/94.2 |
| 2005/0276421 | A1 | 12/2005 | Bergeron et al. | |
| 2008/0199023 | A1 * | 8/2008 | Kantola | 381/92 |

OTHER PUBLICATIONS

Gentex, "Active Noise Reduction (ANR) Flat Module Description," Transaero, Inc., FSC No. 27541, Jun. 1999, (1 Pg.).

* cited by examiner

*Primary Examiner* — Vivian Chin
*Assistant Examiner* — Leshui Zhang
(74) *Attorney, Agent, or Firm* — Garlick & Markison; Timothy W. Markison

(57) ABSTRACT

A circuit includes a microphone circuit, an audio processing module, a digital audio processing module, and an active noise reduction (ANR) circuit. The microphone circuit receives acoustic vibrations and generates an audio signal therefrom. The audio processing module generates a representation of the audio signal. The digital audio processing module compensates the representation of the audio signal based on hearing compensation data to produce a hearing compensated audio signal. The ANR circuit receives the hearing compensated audio signal and an ANR signal. The ANR circuit further functions to adjust the hearing compensated audio signal based on the ANR signal to produce an output audio signal, wherein the ANR signal is generated based on the output audio signal.

21 Claims, 8 Drawing Sheets hearing enhanced system 10

HEARING ENHANCEMENT SYSTEM AND COMPONENTS THEREOF

This patent application is claiming priority under 35 USC §119 to a provisionally filed patent application entitled HEARING ENHANCEMENT SYSTEM AND COMPONENTS THEREOF, having a provisional filing date of Aug. 17, 2009, and a provisional Ser. No. of 61/234,598.

STATEMENT REGARDING FEDERALLY SPONSORED RESEARCH OR DEVELOPMENT

NOT APPLICABLE

INCORPORATION-BY-REFERENCE OF MATERIAL SUBMITTED ON A COMPACT DISC

NOT APPLICABLE

BACKGROUND OF THE INVENTION

1. Technical Field of the Invention

This invention relates generally to mixed signal processing and more particularly to audio signal processing.

2. Description of Related Art

Headphones are known to provide an improved listening experience for listening to a variety of audio sources. For example, headphones may be used in commercial settings (e.g., recording studio, audio laboratories, etc.) to listen to audio content (e.g., music, audio signals, voice signals, etc.) with little to no interference from external sources (e.g., background noise). As another example, headphones may be used in recreational settings (e.g., at home, at the office, etc.) to listen to audio output by a digital audio player (e.g., MP3), an AM/FM radio, a television, a CD player, a DVD player, etc. with reduced interference from external sources and/or for private listening.

In general, a headphone includes one or more speakers (typically two) that can be held closely to the user's ears and circuitry for connecting to an audio source. For example, ear-bud headphones are held close to the user's ears by a pressure fit and include a male audio jack for connecting to a source. As other examples, the headphone may have an ear-cup or on-ear design that fit over the ears; may have a circumaural or full size design that completely surround the ears; or may have a supra-aural design that are light-weight and sits on the ears.

Headsets are known to provide "hands-free" operation of a communication device (e.g., landline telephone, cellular telephone, voice over IP telephone, two-way radio, etc.). As is also known, a headset is essentially a headphone with one or more microphones. In this regard, a headset provides the listening features of a headset with the added ability to transmit voice and/or other audio signals.

To further improve the listening experience, some headphones and/or headsets include noise cancelling circuitry. As is known, the noise cancelling circuitry includes one or more omni-directional microphones to receive noise that is proximal to user but does not receive noise that is further away. The noise received by the microphone may be filtered, amplified, and phase inverted to cause a reduction in proximal noise to the user. An audio signal may also be combined with the noise cancelling circuitry in a manner that allows the system to reproduce the audio signal. In this manner, the audio signal provided to the speaker(s) of the headset or headphone includes the desired audio signal and an inverted version of the noise to be suppressed.

While noise cancelling headsets and/or headphones work well in many situations where the noise level is modest (e.g., on an airplane, in a building, etc.), as the noise level increases, the noise cancelling circuitry becomes unstable and may increase the noise level. For instance, when headsets and/or headphones are used in extremely loud environments (e.g., helicopters, jets, blasting sites (e.g., demolition, military battles, etc.), at a race track, etc.) conventional noise cancelling circuitry is inadequate and a more robust noise cancellation technique is needed. Even with the more robust noise cancellation circuitry, many persons who are regularly exposed to extremely loud environments experience noise-induced hearing loss.

Another issue for headsets/headphones in loud environments is to allow desired surrounding environmental audio signals to be heard while suppressing the undesired noise. This issue may be referred to as localization. For instance, a user may be involved in a communication, thus the incoming voice signals are desired and the background noise (e.g., wind, engine noise, etc.) and loud transient noise (e.g., a gun shot, a engine back-firing, etc.) are undesired. Thus, the desired audio signals should pass through to the speakers (i.e., hear-through) while the background noise and transient noise should be suppressed.

While many headsets/headphones designed for extremely loud environments address one or more of the above issues, they do not address some of the other issues. For example, a headset/headphone may address the loud background noises but does not handle the loud transient noises well or does not provide an adequate level of hear-through considering the hearing profile of the listener.

Therefore, a need exists for a hearing system that functions well in extremely loud environments by addressing the localization problem to provide hear-through, addressing hearing loss, suppressing loud transient noises, and/or suppressing loud background noises.

BRIEF DESCRIPTION OF THE SEVERAL VIEWS OF THE DRAWING(S)

DETAILED DESCRIPTION OF THE INVENTION

Figure 1:
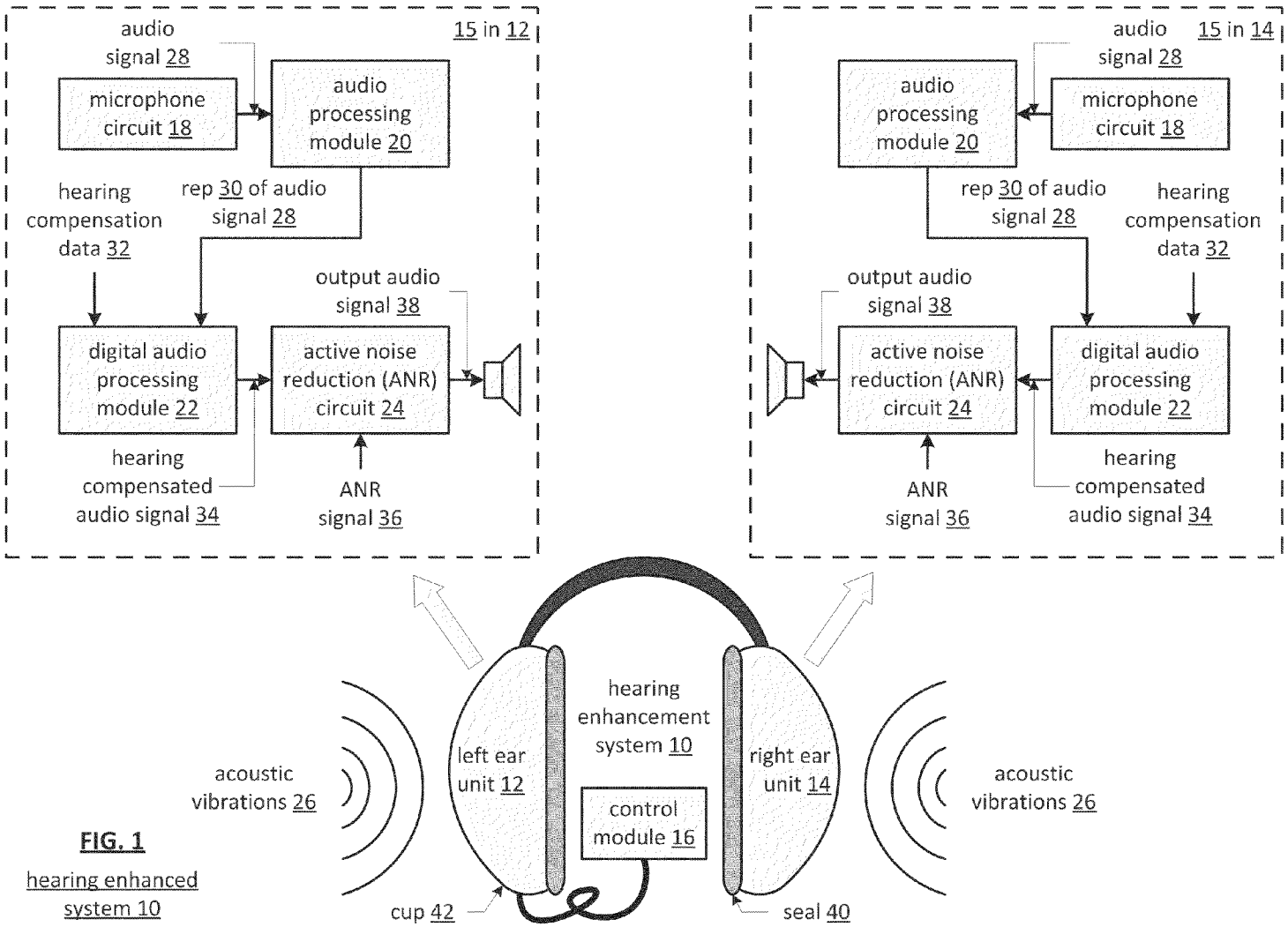
FIG. 1 is a schematic block diagram of an embodiment of a hearing enhancement system in accordance with the present invention.

FIG. 1 is a schematic block diagram of an embodiment of a hearing enhancement system 10 that includes a left ear unit 12, a right ear unit 14, and a control module 16. Each of the left and right ear units 12 and 14 includes a cup housing 42, a circuit 15, and may further include a seal 40. The circuit 15 includes a microphone circuit 18, an audio processing module 20, a digital audio processing module 22, and an active noise reduction (ANR) circuit 24. In this configuration, the hearing enhancement system 10 provides hear-through with reduced localization issues, provides hearing compensation (e.g., hearing aid), and provides active noise reduction for suppressing loud background noises and loud transient noises. As such, the hearing enhancement system 10 is well suited for use in extremely noisy environments.

The audio processing module 20, and the digital audio processing module 22 may be separate processing modules or may be a shared processing module. The control module 16 is a separate processing module. Such a processing module may be a single processing device or a plurality of processing devices. The processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry, inherent functionality of the circuitry (e.g., an operational amplifier amplifies a signal), and/or operational instructions. The processing module may have an associated memory and/or memory element, which may be a single memory device, a plurality of memory devices, and/or embedded circuitry of the processing module. Such a memory device may be a read-only memory, random access memory, volatile memory, non-volatile memory, static memory, dynamic memory, flash memory, cache memory, and/or any device that stores digital information. Note that if the processing module includes more than one processing device, the processing devices may be centrally located (e.g., directly coupled together via a wired and/or wireless bus structure) or may be distributedly located (e.g., cloud computing via indirect coupling via a local area network and/or a wide area network). Further note that when the processing module implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element stores, and the processing module executes, hard coded and/or operational instructions corresponding to at least some of the steps and/or functions illustrated in FIGS. 1-8.

The left cup-shaped housing 42 houses the circuit 15 and is mechanically coupled to a left seal 40. Similarly, the right cup-shaped housing 42 houses the right circuit 15 and is mechanically coupled to the right seal 40. The seals 40 may compromise a torus (e.g., doughnut) shaped structure where an outside pliable material (e.g., plastic, cloth, leather) is filled with a material (e.g., foam, gas, gel, liquid) that compresses as the cup housing 42 is pressed against the user's head around the user's ear. The seals 40 may provide acoustic isolation of the inside of the cup housing 42 from the outside of the cup housing 42 while providing the user greater comfort.

Note that a bladder may be utilized between the cup housing 42 and a helmet worn by the user where the helmet substantially fits on the outside of both of the cup housings 42. The bladder may expand between the helmet and cup housing 42 so as to force the cup housing 42 and the seal 40 against the head to maximize a consistent contact all the way around the seal 40 and the head producing an improved level of acoustic isolation. The bladder is inflatable with air, gas, or a liquid, to provide an adjustable fit to the user's head and ears to improve the consistency of the effectiveness of the seal 40.

In an example of operation, the control module 16 activates the hearing enhanced system 10 in one of a plurality of modes (e.g., which functions are activated and how they will operate). For instance, the control module 16 may activate the hear-through function only, the active noise reduction (ANR) function only, or both the hear-through function and the ANR function. In another instance, the control module 16 may activate the digital audio processing module 22 to operate in an auto-adaptive mode to self-vary operational parameters as a function of the environmental noise, which may include starting point operational parameters (e.g., parameters for an expected noise environment). In addition, the control module 16 may deactivate the hearing enhanced system 10. The control module 16 may also include a reset function that resets the hearing enhancement system 10 to default settings (e.g., volume level, equalization, compression, etc.) and/or default modes of operation (e.g., both hear-through and ANR active). The control module 16 may also specify operational parameters for activated functions including parameters or auto-adaptive parameter ranges for multi-band equalization, noise reduction, and multi-hearing modes for producing the hearing compensated audio signal based on the hearing compensation data.

When the hear-through function and ANR function are active, the microphone circuits 18 of the left and/or right ear unit 12 and 14 receive acoustic vibrations 26 in a proximal environment. The acoustic vibrations 26 may correspond to speech, noise, and/or any other sound (e.g., music, foot-steps, wind, etc.). The microphone circuits 18 (embodiments of which will be described in greater detail with reference to FIGS. 4, 6, and 7) generate an audio signal 28 based on the acoustic vibration 26. The audio signal 28 may be an analog signal is amplified, filtered, level shifted, etc., by the microphone circuit 18.

In this mode, the audio processing module 20 is enabled to generate a representation 30 of the left audio signal 28. In general, the audio processing module 20 performs the hear-through function when it is enabled. For example, the audio processing module 20 receives the audio signal 28 in the analog domain. The audio signal 28 includes a desired signal component (e.g., voice signals and/or any other sounds of interest (e.g., distant gun fire, verbal signals, sounds associated with movement, etc.)) and undesired signal component (e.g., background noise, wind, loud transients, etc.).

The audio processing module 20 may include an analog to digital converter that converts the audio signal 28 into a digital signal. In the digital domain, the audio processing module 20 separates the desired signal component from the undesired signal component. It then attenuates the undesired signal component and passes the desired signal component substantially unattenuated. This may be done in a variety of ways. For example, the audio processing module 20 may analyze the digital signal to detect the undesired signal component (e.g., noise, transients, etc.) using one or more matched filters, audio correlation, audio codebook look ups, etc. Having isolated the undesired signal component, the audio processing module 20 filters it to produce the representation 30 of the audio signal 28.

In another mode, the audio processing module 20 may be enabled to convert the audio signal 28 into a digital signal and pass the digital signal onto the digital audio processing module 22 as the representation 30 of the audio signal 28. In this mode, whatever digital audio processing that is enabled is performed by the digital audio processing module 22.

When the digital audio processing module 22 is enabled, it compensates the representation 30 of the left audio signal 28 based on hearing compensation data 32 to produce a digital compensated audio signal. The hearing compensation data 32 may correspond to a custom hearing aid profile of the user or a generic hearing aid profile. The digital audio processing module 22, via a digital to analog converter, converts the digital compensated audio signal into a hearing compensated audio signal 34.

The active noise reduction (ANR) circuit, when enabled, receives the hearing compensated audio signal 34 and an ANR signal 36. The ANR circuit then adjusts the hearing compensated audio signal 34 based on the ANR signal 36 to produce an output audio signal 38. Various embodiments of the ANR circuit will be described with reference to FIGS. 2 and 3.

Figure 2:
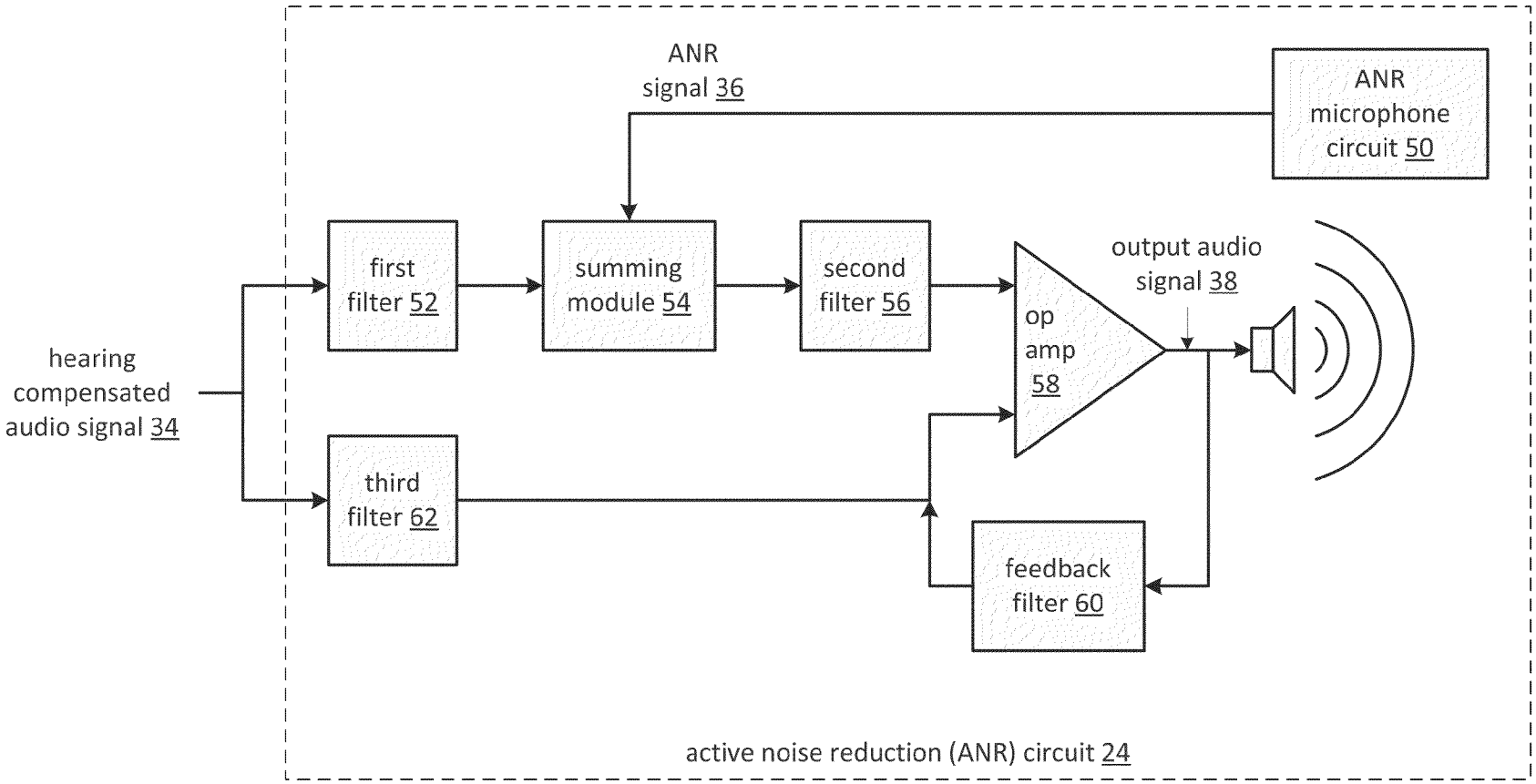
FIG. 2 is a schematic block diagram of an embodiment of an active noise reduction circuit in accordance with the present invention.

FIG. 2 is a schematic block diagram of an embodiment of an active noise reduction (ANR) circuit 24 that includes an ANR microphone circuit 50, a first filter 52, a summing module 54, a second filter 56, an operational amplifier 58, a feedback filter 60, and a third filter. The ANR microphone circuit receives the output audio signal 38 via the acoustic vibrations produced by the speaker and generates the ANR signal therefrom. In an embodiment, the ANR microphone circuit includes a microphone, a biasing circuit, an adjustable gain stage, and may further include filtering. For example, the microphone may be an inverting microphone that includes a standard electrical condenser and a built-in inverting pre-amplifier.

The first filter 52, which may include a blocking capacitor, high pass filters the hearing compensated audio signal 34 to produce a filtered hearing compensated audio signal. In addition to blocking a DC component of the hearing compensated audio signal 34, the first filter 52 sets the signal level to be injected into the summing module 54.

The summing module 54 sum the filtered hearing compensated audio signal and the ANR signal 36 to produce a summed audio signal. In an embodiment, the summing module may be implemented as a three-wire connection. In another embodiment, the summing module is an analog adder. Note that the summing module 54 may include a resistor to provide power to the microphone circuit 50.

The second filter 56 filter the summed audio signal to produce a filtered summed audio signal. In an embodiment, the second filter 56 includes phase-controlled high-pass filter components and may further include phase-controlled low-pass filter components. For example, a resistor-capacitor circuit may establish the corner frequency for the high pass function. Similarly, a resistor-capacitor circuit may establish the corner frequency for the low pass function. Phase control is used to ensures that the second filter 56 does not phase shift the summed signal by more than 90 degrees.

The third filter 62 high pass filters the hearing compensated audio signal 34 to produce a high pass filtered hearing compensated audio signal. The corner frequency of the third filter is set near the top of the ANR range (e.g., 1 KHz to 2 KHz) to extended the high frequency audio response above the ANR range and functions to compensate for the roll-off of the feedback filter 60.

The feedback filter 60 filters the output audio signal 38 to produce a feedback signal and assists in controlling the phase shift of the amplifier 58. In an embodiment, the feedback filter 60 includes phase controlled low pass and high pass components that are set to the voltage gain of the amplifier 58. The operational amplifier 58 includes an inverting input, a non-inverting input, and an output, wherein the non-inverting input receives the summed audio signal, the inverting input receives the feedback signal and the high pass filtered hearing compensated audio signal, and the output outputs the output audio signal 38 to one or more speakers.

Figure 3:
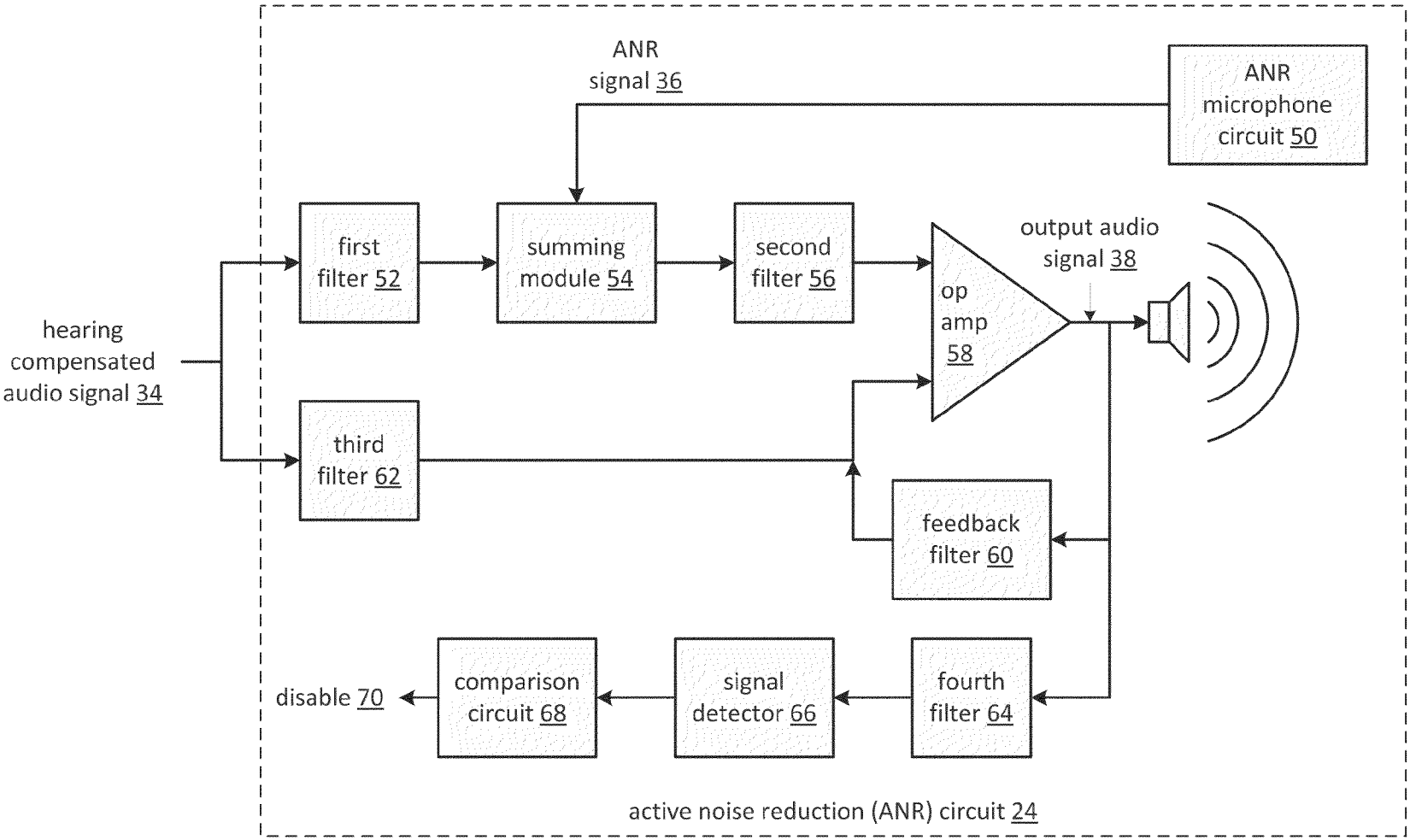
FIG. 3 is a schematic block diagram of another embodiment of an active noise reduction circuit in accordance with the present invention.

FIG. 3 is a schematic block diagram of another embodiment of an active noise reduction circuit 24 of FIG. 2 plus a fourth filter 64, a signal detector 66, and a comparison circuit 68.

The fourth filter 64 high pass filters the output audio signal 38 to produce a high pass filtered output audio signal. The fourth filter 64 includes passive and/or active components to produce a high pass filter that has a corner frequency above a normal voice range (e.g., >2 KHz) to detect undesired feedback in the output signal 38.

The signal detector 66 converts the high pass filtered output audio signal into a proportional direct current (DC) signal. The signal detector 66 may be a comparator with hysteresis to avoid false triggering from transients of the output signal 38. The comparison circuit 68, which may be a latch, disables the ANR circuit 24 when the proportional DC signal compares unfavorably to a high frequency feedback threshold voltage. This prevents the feedback from causing a squeal in the output signal that is irritating, if not harmful, the user of the system 10. The control module 16 can reset the ANR circuit if it is disabled in this manner.

In general, the ANR circuit 24 produces an inverse output proportional to the ANR microphone signal to effect cancellation of ambient acoustic noise. The amount of noise reduction is proportional to the amplifier gain, and to the gain of the speaker-microphone combination. For example, if at a certain frequency the speaker-microphone gain is −0.2 and the amplifier gain (including filter loss) is +50, then the overall system gain will be −10, thus there will be 20 db of noise reduction.

With an amplifier gain of 50, a 20 millivolt microphone signal produces a 1 volt output on the speaker, which normally would produce a 200 mV signal on the microphone (gain of −0.2) but because it is combining with the noise being cancelled with 20 db of noise reduction (10 times voltage ratio), it is reduced to 20 mV. In other words, if the system is exposed to external sound that would normally result in 200 mV from the microphone, the system will output a counter signal to the speaker that drives the microphone signal level to 20 mV.

Figure 4:
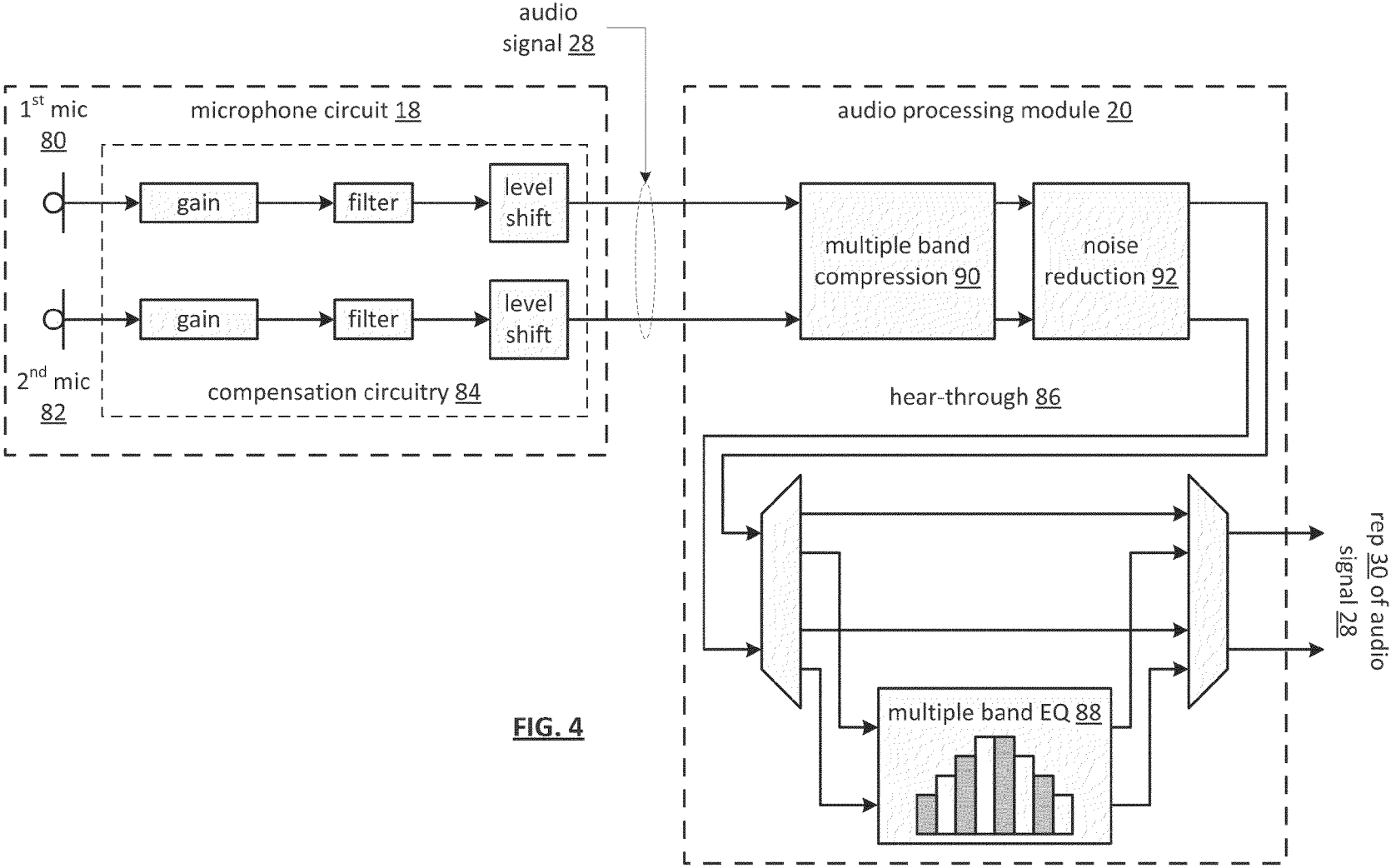
FIG. 4 is a schematic block diagram of an embodiment of a microphone circuit and an audio processing module in accordance with the present invention.

FIG. 4 is a schematic block diagram of an embodiment of a microphone circuit 18 and an audio processing module 20. The microphone circuit 18 includes one or more first microphones 80, one or more second microphones 82, and compensation circuitry 84. The audio processing module 20 includes a multiple band compression module 90, a noise reduction module 92, and a selectable multiple band equalizer module 88. The combination of the compression module 90, the noise reduction module 92, and the equalizer module 88 perform a hear-through function 86.

In an example of operation, the microphones 80 and 82 receive the acoustic vibrations 26 to produce analog signals representative of the acoustic vibrations. The positioning of the microphones 80 and 82 within the left or right ear unit is such that they form a diversity microphone structure (e.g., are physically distributed such that the microphones 80 and 82 will receive the acoustic vibrations at different times depending on the position of the source of the vibrations relative to the microphones).

The microphone compensation circuitry 84 compensates the first and second analog audio signals to produce the audio signal 28. To perform the compensation, the compensation circuitry 84 may include one or more of an analog gain stage, a filtering stage (e.g., low pass, high pass, or band pass), and/or a level shift stage (adjust DC and/or AC level of the audio signal 28).

The audio processing module 20 receives the audio signal 28 and performs a hear-through function thereon. The hear-through function includes one or more of a multiple band compression, noise reduction, and a multiple band equalization. For multiple band compression, the audio frequency spectrum (e.g., 0-20 KHz) is divided into a plurality of frequency bands of equal or unequal spacing. For example, the audio frequency spectrum may be equally divided into 20 1-KHz bands. As another example, the 0-4 KHz portion of the frequency range may be divided into a 100 Hz to 1 KHz bands and the remainder of the range divided into 1-4 bands. Regardless of how the audio frequency spectrum is divided into frequency bands, each frequency band may have an individually set amplitude threshold to which the signal component in the frequency band is compressed. Note that the multiple frequency band compression 90 may be done in the analog domain or the digital domain. If done in the digital domain, the audio signal 28 is converted into a digital signal prior to compression.

The noise reduction module 92 functions to isolate the undesired signal component of the audio signal 28 from the undesired signal component. In general, this may be done in the analog domain by identifying the undesired signal component, generating an inversion thereof, and mixing it with the audio signal to yield the desired signal component. If done in the digital domain, the noise reduction module 92 separates the desired signal component from the undesired signal component. It then attenuates the undesired signal component and passes the desired signal component substantially unattenuated. This may be done in a variety of ways. For example, the noise reduction module 92 may analyze the digital signal to detect the undesired signal component (e.g., noise, transients, etc.) using one or more matched filters, audio correlation, audio codebook look ups, etc.

The multiple band equalization module 88 may be bypassed via the multiplexers, or equivalent hardware and/or software, or engaged. If engaged, the multiple band equalizer module 88 adjusts amplitudes of various frequency bands to produce the representative 30 of the audio signal 28. Note that the equalization may be done in the analog domain or in the digital domain.

Figure 5:
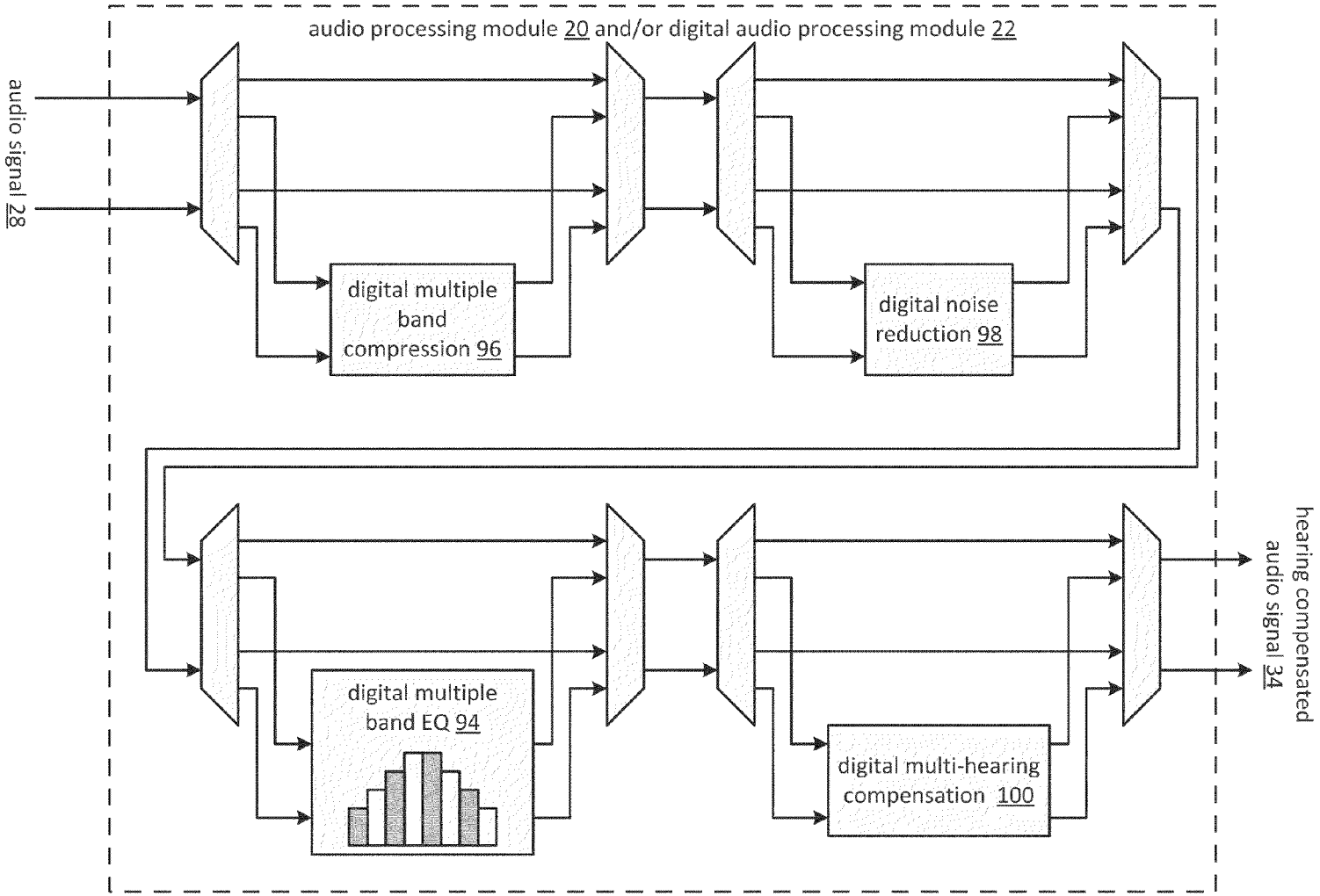
FIG. 5 is a schematic block diagram of an embodiment of an audio processing module and/or a digital audio processing module in accordance with the present invention.

FIG. 5 is a schematic block diagram of an embodiment of an audio processing module 20 and/or a digital audio processing module 22 performing one or more of digital multiple band compression 96, digital noise reduction 98, digital multiple band equalization 94, and digital multi-hearing compensation 100. These digital functions may be done in conjunction with the corresponding functions previously discussed with reference to FIG. 4 or in place of them.

In the digital domain, the digital multiple band compression module 96, the digital noise reduction module 98, and the digital multiple band equalizer module 94 function similarly to their counterparts in FIG. 4. The digital multi-hearing compensation module 100 provides various modes for modifying the audio signal 28 to produce the hearing compensated audio signal 34. The digital multi-hearing compensation module 100 may be a separate module as shown that adjusts the signal it receives in accordance with one of a plurality of hearing compensation data (e.g., hearing aid profiles). Alternatively, the digital multi-hearing module 100 may not be in the path of converting the audio signal 28 into the hearing compensated audio signal 34, but a control module that provides inputs to the digital multiple band compression module 96 and/or to the digital multiple band equalizer module 94 such that at least one of these modules 94 and 96 performs the hearing compensation of the audio signal.

Figure 6:
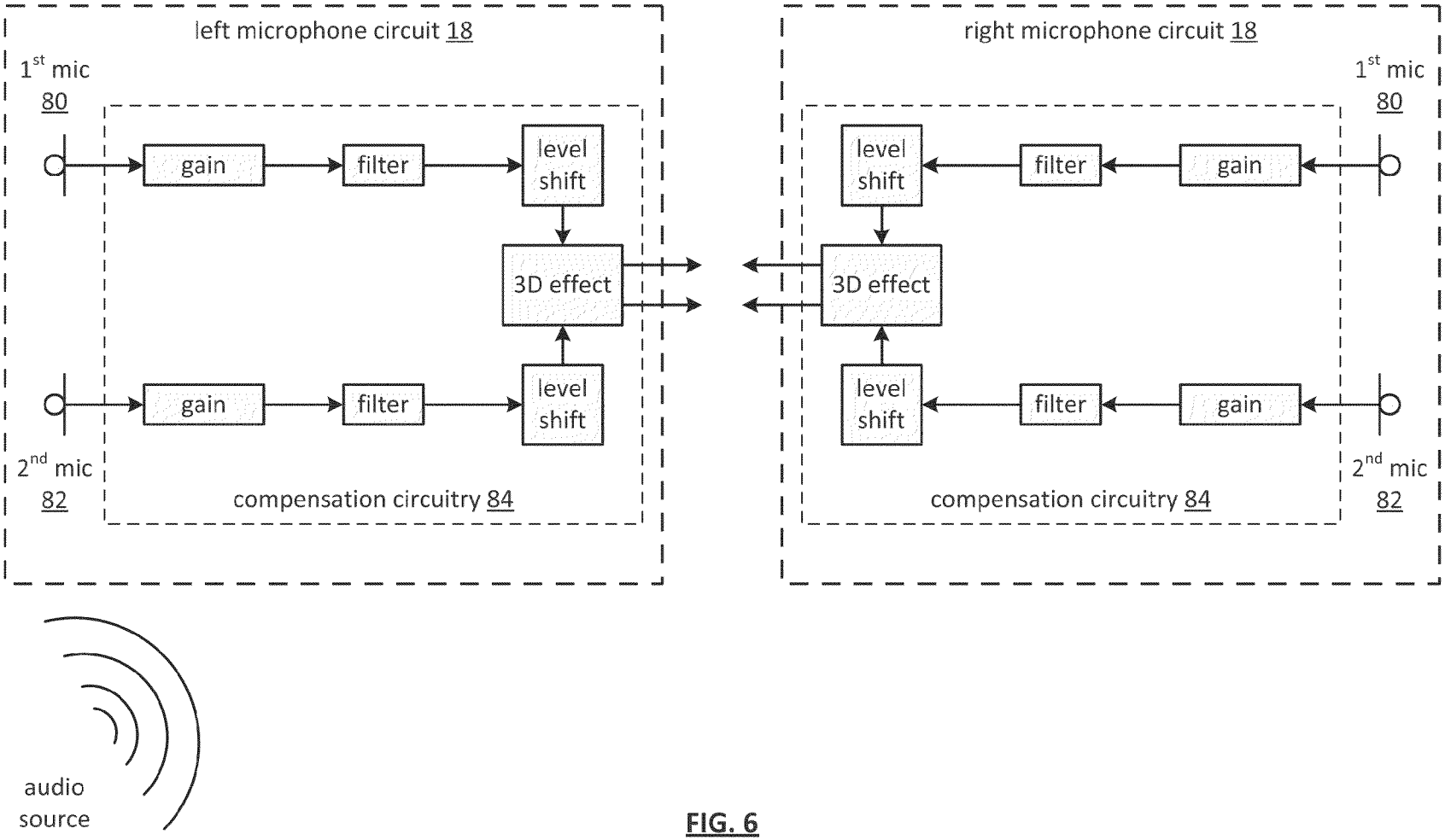
FIG. 6 is a schematic block diagram of an embodiment of a microphone circuit in accordance with the present invention.

FIG. 6 is a schematic block diagram of an embodiment of a microphone circuit 18 that includes the one or more first microphones 80, the one or more second microphones 82, and the compensation circuitry 84 in each of the left and right ear units 12 and 14. In addition to the functions of the compensation circuitry 84 previously discussed with reference to FIG. 4, the compensation circuitry 84 further includes a three-dimensional (3D) effect module.

In general, the 3D effect module compensates the first and second analog audio signals based on a natural cardioid pattern to produce the left and right audio signal having three-dimensional characteristics. For example, if an audio source is positioned in two-dimensional space closer to the left microphone circuit 18 than the right one and, on the left side, is closer to the second microphone 82 than the first microphone 80, then each of the microphones will receive the vibrations of the audio source at different times. By maintaining the temporal information of the audio input signals, a three-dimensional representation of the audio signal is provided via the 3D effect module to the audio processing module 20. Note that the 3D effect module may be implemented using analog circuitry or digital circuitry to produce the 3D effect, or a surround sound effect.

Figure 7:
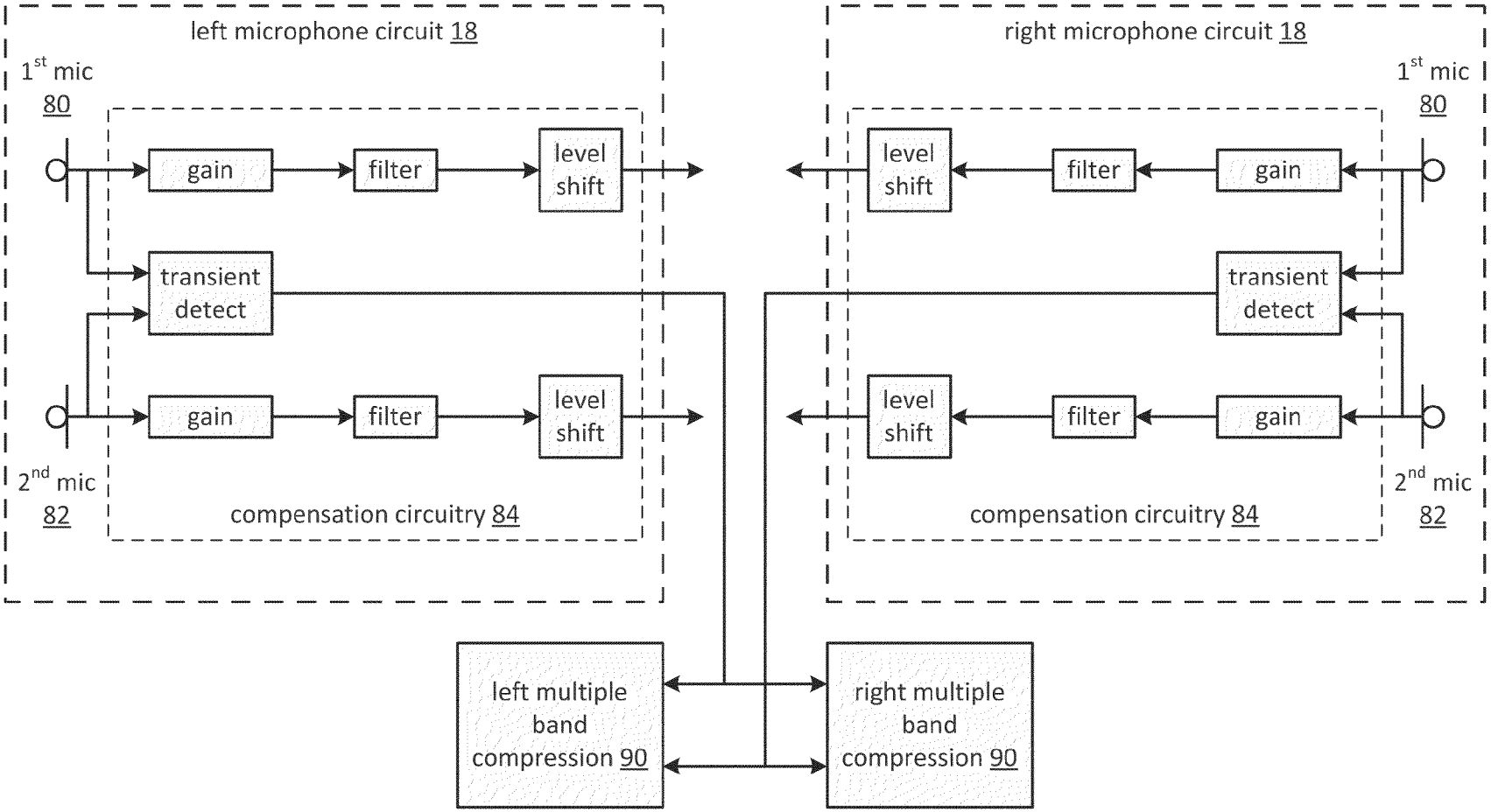
FIG. 7 is a schematic block diagram of an embodiment of a microphone circuit in accordance with the present invention.

FIG. 7 is a schematic block diagram of an embodiment of a microphone circuit 18 that includes the one or more first microphones 80, the one or more second microphones 82, and the compensation circuitry 84 in each of the left and right ear units 12 and 14. In addition to the functions of the compensation circuitry 84 previously discussed with reference to FIG. 4, the compensation circuitry 84 further includes a transition detect module. Alternatively, the transition detect module may be in the audio processing module 20.

Regardless of which higher level module implements the transition detection module, the transition detection module functions to detect large transients (e.g., detect loud sudden noises such as a gun shot, etc.). To detect the large transients, the transient detect module may be coupled to the microphones as shown, or may be coupled to after any functional block of the compensation circuitry.

When a transition detect module in either the left or right ear unit detects a large transient, it provides a signal to both the left and right multiple band compression modules 90 such that the loud sudden noise is suppressed in both ears. By activating both sides' compression modules 90, the three-dimensional information of the noise is preserved.

Figure 8:
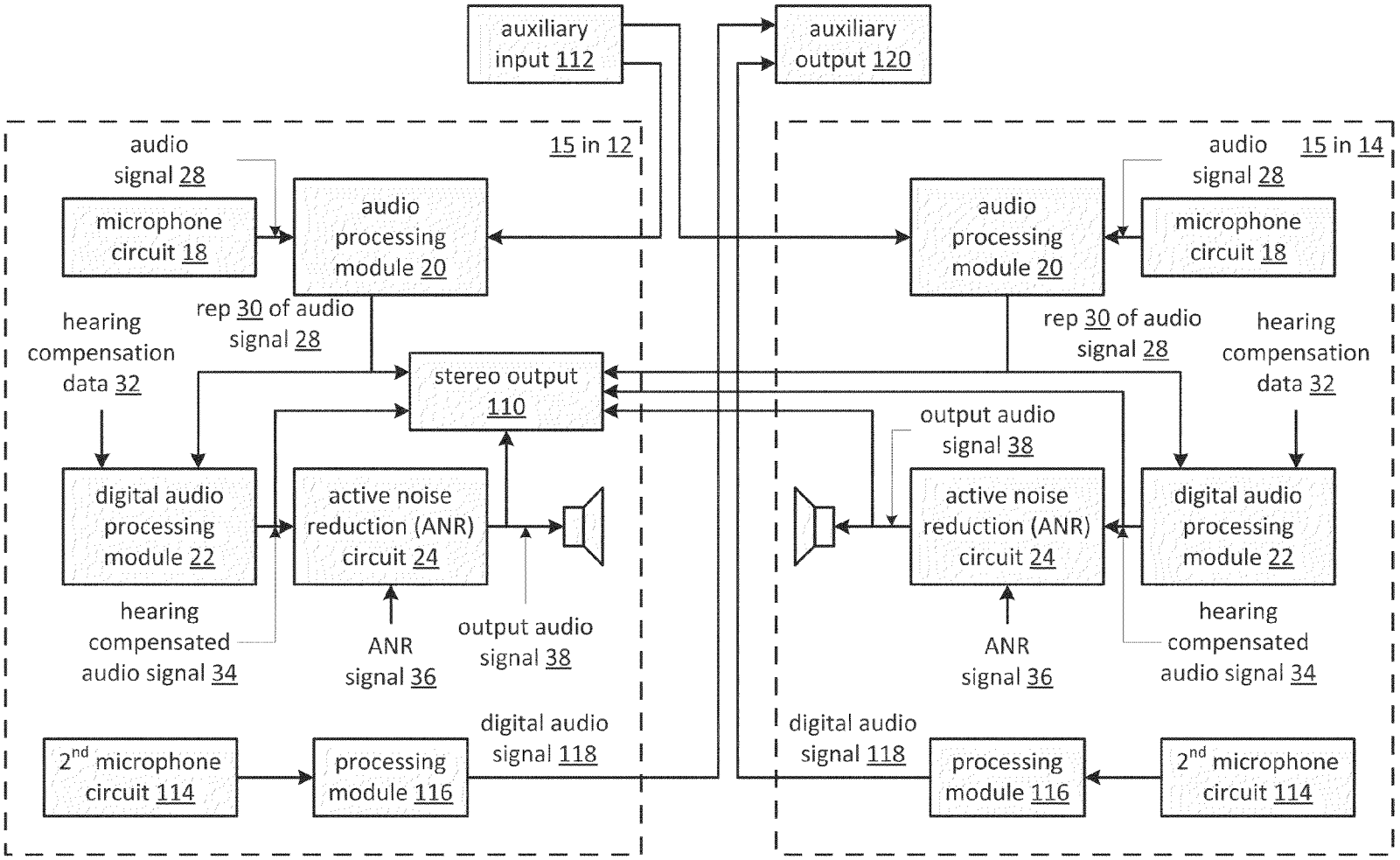
FIG. 8 is a schematic block diagram of another embodiment of a hearing enhancement system in accordance with the present invention.

FIG. 8 is a schematic block diagram of another embodiment of a hearing enhancement system 10 that includes the circuit 15 in each of the left and right ear units 12 and 14. The system 10 further includes a stereo output 110, an auxiliary input 112, and an auxiliary output 120. The circuit 15 includes the microphone circuit 18, the audio processing module 20, the digital audio processing module 22, the ANR circuit 24, a second microphone circuit 114, and a processing module 116. The processing module 116 may be a separate processing module or a shared processing module with the digital audio processing module 22.

The auxiliary input 112 may be an audio jack, a two or three-wire connection (e.g., $I^2C$), or other type of connector that is capable of receiving an auxiliary audio signal from a communication device. For example, the control unit 16 may receive a signal from a two-way communication device and provide it via the auxiliary input 112 to the left and right ear units 12 and 14. In this instance, the audio processing module 20 mixes the audio signal 28 with the auxiliary audio signal to produce a mixed audio signal. The mixed audio signal is then processed as previously discussed with the processing of the audio signal 28 to produce the representation 30

The stereo output 110 may include a left and right audio multiplexer and a connector. The stereo output 110, which may be within one of the left or right ear units 12 or 14, or within the control module 16, outputs a representation of the left and right output signals 38. The representation may be selected by the multiplexer and may include one or more of the representation 30 (e.g., including the signal from the auxiliary input 112 and/or the representation of the audio signal 28), the hearing compensated audio signal 34, and/or the output audio signal 38.

In an embodiment, the stereo output 110 includes a female audio jack for connection to a male audio plug affiliated with a set of ear bud speakers. The stereo output 110 may route the hearing compensated audio signal 34 to the audio jack. In this instance, the user may wear the ear bud headphones underneath the left and right ear units to further improve performance of the system 10. This may be especially useful in extremely loud and sudden noise situations (e.g., detonation of an explosive) where the shock wave of the noise temporarily lifts the ear cups off the user's ears.

The control module 16 may control the multiplexer selection based on an operational mode. For example, the control module 16 may select the representation 30 where the representation 30 only includes the auxiliary audio signal from the communication device when the mode is to listen exclusively to the communication device (e.g., for high priority radio traffic).

The second microphone circuit 114 receives spoken audible sounds from the user of the system 10 and generates a voice signal therefrom. The second microphone circuit 114 includes one or more microphones and microphone compensation circuitry (e.g., circuitry 84 of FIG. 4). The one or more microphones are physically located on the left and/or right ear units 12 and/or 14 to easily receive utterances from the user.

The processing module 116 converts the voice signal into a digital audio signal 188. Such a conversion includes one or more of analog to digital conversion, audio processing (e.g., MPEG encoding), audio compression, etc. The processing module 116 provides the digital audio signal 118 to the auxiliary output 120.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

While the transistors in the above described figure(s) is/are shown as field effect transistors (FETs), as one of ordinary skill in the art will appreciate, the transistors may be implemented using any type of transistor structure including, but not limited to, bipolar, metal oxide semiconductor field effect transistors (MOSFET), N-well transistors, P-well transistors, enhancement mode, depletion mode, and zero voltage threshold (VT) transistors.

The present invention has also been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention.

The present invention has been described above with the aid of functional building blocks illustrating the performance of certain significant functions. The boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

What is claimed is:

1. A circuit comprises:

a microphone circuit operably coupled to:
- receive acoustic vibrations in a proximal environment; and
- generate an audio signal based on the acoustic vibration;

an audio processing module operably coupled to generate a representation of the audio signal;

a digital audio processing module operably coupled to compensate the representation of the audio signal based on hearing compensation data to produce a hearing compensated audio signal; and an active noise reduction (ANR) circuit including:

an ANR microphone circuit operably coupled to:
- receive the output audio signal; and
- generate an ANR signal based on the output audio signal;

a first filter operably coupled to high pass filter the hearing compensated audio signal to produce a filtered hearing compensated audio signal;

a summing module operably coupled to sum the filtered hearing compensated audio signal and the ANR signal to produce a summed audio signal;

a second filter operably coupled to filter the summed audio signal to produce a filtered summed audio signal;

an operational amplifier having an inverting input, a non-inverting input, and an output, wherein the non-inverting input receives the summed audio signal and the output outputs an output audio signal;

a feedback filter operably coupled to filter the output audio signal to produce a feedback signal; and a third filter operably coupled to high pass filter the hearing compensated audio signal to produce a high pass filtered hearing compensated audio signal, wherein the feedback signal and the high pass filtered hearing compensated audio signal are received by the inverting input of the operational amplifier.

2. The circuit of claim 1, wherein the ANR circuit further comprises:

a fourth filter operably coupled to high pass filter the output audio signal to produce a high pass filtered output audio signal;

a signal detector operably coupled to convert the high pass filtered output audio signal into a proportional direct current (DC) signal; and a comparison circuit operably coupled to disable the ANR circuit when the proportional DC signal compares unfavorably to a high frequency feedback threshold voltage.

3. The circuit of claim 1 further comprises the audio processing module generating the representation of the audio signal by at least one of:

performing a hear-through function that includes:

performing multiple band compression; and performing noise reduction; and performing multiple band equalization.

4. The circuit of claim 1 further comprises at least one of the audio processing module and the digital audio processing module digitally performing one or more of:

multi-band compression;

multi-band equalization;

noise reduction; and multi-hearing modes for producing the hearing compensated audio signal based on the hearing compensation data.

5. The circuit of claim 1, wherein the microphone circuit comprises:

one or more left microphones operably coupled to generate a left analog audio signal based acoustic vibrations;

one or more right microphones operably coupled to generate a right analog audio signal based acoustic vibrations; and microphone compensation circuitry operably coupled to compensate the left and right analog audio signals to produce the audio signal.

6. The circuit of claim 5 further comprises the microphone compensation circuitry operably coupled to:

compensate the left and right analog audio signals based on a natural cardioid pattern to produce the audio signal having three-dimensional characteristics.

7. The circuit of claim 5 further comprises:

a transient detect module operably coupled to detect a loud transient within at least one of the first and second analog audio signals of the left or the right ear unit; and when the loud transient is detected, the transient detect module provides a signal to the audio processing module to compress the left and right audio signals to a desired level.

8. The circuit of claim 1 further comprises:

a stereo output operably coupled to output a representation of the output audio signal, wherein the stereo output is capable of connecting to a set of ear bud speakers.

9. The circuit of claim 1 further comprises:

an auxiliary input operably coupled to receive an auxiliary audio signal from a communication device; and the audio processing module operably coupled to:

mix the audio signal and the auxiliary audio signal to produce a mixed audio signal;

generate a second representation of the mixed audio signal;

the digital audio processing module operably coupled to compensate the second representation of the mixed audio signal based on the hearing compensation data to produce a hearing compensated mixed audio signal; and the ANR circuit operably coupled to:

receive the hearing compensated mixed audio signal;

receive the ANR signal; and adjust the hearing compensated mixed audio signal based on the ANR signal to produce a mixed output audio signal, wherein the ANR signal is generated based on the output audio signal.

10. The circuit of claim 1 further comprises:

a second microphone circuit operably coupled to:

receive spoken audible sounds; and generate a voice signal based on the spoken audible sounds; and a processing module operably coupled to convert the voice signal into a digital audio signal.

11. A hearing enhancement system comprises:

a left ear unit that includes:

a left microphone circuit operably coupled to:

receive left acoustic vibrations in a proximal environment; and generate a left audio signal based on the left acoustic vibration;

a left audio processing module, when enabled, is operably coupled to generate a representation of the left audio signal;

a left digital audio processing module, when enabled, is operably coupled to compensate the representation of the left audio signal based on left hearing compensation data to produce a left hearing compensated audio signal; and a left active noise reduction (ANR) circuit, when enabled, is operably coupled to:

receive the left hearing compensated audio signal;

receive a left ANR signal; and adjust the left hearing compensated audio signal based on the left ANR signal to produce a left output audio signal, wherein the left ANR signal is generated based on the left output audio signal;

a right ear unit that includes:

a right microphone circuit operably coupled to:

receive right acoustic vibrations in the proximal environment; and generate a right audio signal based on the right acoustic vibration;

a right audio processing module, when enabled, is operably coupled to generate a representation of the right audio signal;

a right digital audio processing module, when enabled, is operably coupled to compensate the representation of the right audio signal based on right hearing compensation data to produce a right hearing compensated audio signal; and a right ANR circuit, when enabled, is operably coupled to:

receive the right hearing compensated audio signal;

receive a right ANR signal; and adjust the right hearing compensated audio signal based on the right ANR signal to produce a right output audio signal, wherein the right ANR signal is generated based on the right output audio signal; and a control unit operably coupled to selectively enable one or more of the left and right audio processing modules, the left and right digital audio processing modules, and the left and right ANR circuits, wherein each of the left and right ANR circuits comprises:

an ANR microphone circuit operably coupled to:

receive the left or right output audio signal; and generate the left or right ANR signal based on the left or right output audio signal;

a first filter operably coupled to high pass filter the left or right hearing compensated audio signal to produce a filtered hearing compensated audio signal;

a summing module operably coupled to sum the filtered hearing compensated audio signal and the left or right ANR signal to produce a summed audio signal;

a second filter operably coupled to filter the summed audio signal to produce a filtered summed audio signal;

an operational amplifier having an inverting input, a non-inverting input, and an output, wherein the non-inverting input receives the summed audio signal and the output outputs the left or right output audio signal;

a feedback filter operably coupled to filter the left or right output audio signal to produce a feedback signal; and a third filter operably coupled to high pass filter the left or right hearing compensated audio signal to produce a high pass filtered hearing compensated audio signal, wherein the feedback signal and the high pass filtered hearing compensated audio signal are received by the inverting input of the operational amplifier.

12. The hearing enhancement system of claim 11 further comprises:

the left ear unit including:

a left cup-shaped housing that houses the left microphone circuit, the left audio processing module, the left digital audio processing module, and the left ANR circuit; and a left seal coupled to the left cup-shared housing; and the right ear unit including:

a right cup-shaped housing that houses the right microphone circuit, the right audio processing module, the right digital audio processing module, and the right ANR circuit; and a right seal coupled to the right cup-shared housing.

13. The hearing enhancement system of claim 11, wherein each of the left and right ANR circuit further comprises:

a fourth filter operably coupled to high pass filter the left and right output audio signal to produce a high pass filtered output audio signal;

a signal detector operably coupled to convert the high pass filtered output audio signal into a proportional direct current (DC) signal; and a comparison circuit operably coupled to disable the left and right ANR circuit when the proportional DC signal compares unfavorably to a high frequency feedback threshold voltage.

14. The hearing enhancement system of claim 11 further comprises the left and right audio processing module generating the representation of the left and right audio signal by at least one of:

performing a hear-through function that includes:

performing multiple band compression; and performing noise reduction; and performing multiple band equalization.

15. The hearing enhancement system of claim 11 further comprises at least one of the left and right audio processing module and the left and right digital audio processing module digitally performing one or more of:

multi-band compression;

multi-band equalization;

noise reduction; and multi-hearing modes for producing the left and right hearing compensated audio signal based on the left and right hearing compensation data.

16. The hearing enhancement system of claim 11, wherein the left and right microphone circuit comprises:

one or more first microphones operably coupled to generate a first analog audio signal based acoustic vibrations;

one or more second microphones operably coupled to generate a second analog audio signal based acoustic vibrations; and microphone compensation circuitry operably coupled to compensate the first and second analog audio signals to produce the left and right audio signal.

17. The hearing enhancement system of claim 16 further comprises the microphone compensation circuitry operably coupled to:

compensate the first and second analog audio signals based on a natural cardioid pattern to produce the left and right audio signal having three-dimensional characteristics.

18. The hearing enhancement system of claim 16 further comprises:

a transient detect module operably coupled to detect a loud transient within at least one of the first and second analog audio signals of the left or the right ear unit; and when the loud transient is detected, the transient detect module provides a signal to the audio processing module to compress the left and right audio signals to a desired level.

19. The hearing enhancement system of claim 11 further comprises:

a stereo output operably coupled to output the left and right output audio signals, wherein the stereo output is capable of connecting to a set of ear bud speakers.

20. The hearing enhancement system of claim 11 further comprises:

an auxiliary input operably coupled to receive an auxiliary audio signal from a communication device; and at least one of the left and right audio processing modules operably coupled to:

mix at least one of the left and right audio signals with the auxiliary audio signal to produce a mixed audio signal;

generate a second representation of the mixed audio signal;

at least one of the left and right digital audio processing modules operably coupled to compensate the second representation of the mixed audio signal based on at least one of the left and right hearing compensation data to produce a hearing compensated mixed audio signal; and at least one of the left and right ANR circuit operably coupled to:

receive the hearing compensated mixed audio signal;

receive at least one of the left and right ANR signals; and adjust the hearing compensated mixed audio signal based on the at least one of the left and right ANR signals to produce a mixed output audio signal.

21. The hearing enhancement system of claim 11 further comprises:

a second microphone circuit operably coupled to:

receive spoken audible sounds; and generate a voice signal based on the spoken audible sounds; and a processing module operably coupled to convert the voice signal into a digital audio signal.

* * * * *